US010586552B2

(12) United States Patent
Li

(10) Patent No.: US 10,586,552 B2
(45) Date of Patent: Mar. 10, 2020

(54) CAPTURE AND EXTRACTION OF OWN VOICE SIGNAL

(71) Applicant: DOLBY LABORATORIES LICENSING CORPORATION, San Francisco, CA (US)

(72) Inventor: Chunjian Li, Beijing (CN)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 16/073,265

(22) PCT Filed: Feb. 24, 2017

(86) PCT No.: PCT/US2017/019360
§ 371 (c)(1),
(2) Date: Jul. 26, 2018

(87) PCT Pub. No.: WO2017/147428
PCT Pub. Date: Aug. 31, 2017

(65) Prior Publication Data

US 2019/0043518 A1 Feb. 7, 2019

Related U.S. Application Data

(60) Provisional application No. 62/328,841, filed on Apr. 28, 2016.

(30) Foreign Application Priority Data

Feb. 25, 2016 (WO) ..... PCT/CN2016/074547
Mar. 30, 2016 (EP) ..... 16162742

(51) Int. Cl.
*G10L 21/0216* (2013.01)
*G10L 25/84* (2013.01)
(Continued)

(52) U.S. Cl.
CPC ..... *G10L 21/0216* (2013.01); *G10L 21/02* (2013.01); *G10L 25/03* (2013.01);
(Continued)

(58) Field of Classification Search
CPC ..... G10L 21/02; G10L 21/0208; G10K 11/16; G10K 11/175; H04R 5/02; H04R 1/10
(Continued)

(56) References Cited

U.S. PATENT DOCUMENTS 5,251,263 A 10/1993 Andrea
7,512,245 B2 3/2009 Rasmussen
(Continued)

FOREIGN PATENT DOCUMENTS

EP 2555189 2/2013
WO 02/080615 10/2002
WO 2014/194932 12/2014

OTHER PUBLICATIONS

Kondo, K. et al "On Equalization of Bone Conducted Speech for Improved Speech Quality" IEEE International Symposium on Signal Processing and Information Technology, Aug. 1, 2006, pp. 426-431.

*Primary Examiner* — Akwasi M Sarpong

(57) ABSTRACT

Methods and systems employing an internal microphone and an external microphone of a headset to capture own voice content in the presence of noise, extract the own voice content from background noise (by performing noise reduction on the microphone outputs to generate a noise reduced signal indicative of the own voice content), and optionally also perform voice activity detection to identify segments of own voice presence or absence. In some embodiments, the external microphone is employed to capture the own voice content, the internal microphone signal is employed to infer the noise captured by the external microphone, and the inferred noise is subtracted from the external microphone
(Continued)

signal to generate the noise reduced signal. Aspects include methods performed by any embodiment of the system, and a system or device configured (e.g., programmed) to perform any embodiment of the method.

20 Claims, 2 Drawing Sheets

(51) Int. Cl.

| | |
|---|---|
| ***G10L 25/78*** | (2013.01) |
| ***H04R 3/00*** | (2006.01) |
| ***G10L 21/02*** | (2013.01) |
| ***G10L 25/03*** | (2013.01) |

(52) U.S. Cl.
CPC ..... *G10L 25/84* (2013.01); *H04R 3/005* (2013.01); *G10L 25/78* (2013.01); *G10L 2021/02165* (2013.01); *H04R 2201/107* (2013.01); *H04R 2410/05* (2013.01)

(58) Field of Classification Search
USPC ..... 704/228; 381/71.4, 311, 103, 86
See application file for complete search history.

(56) References Cited

U.S. PATENT DOCUMENTS

| | | | | |
|---|---|---|---|---|
| 7,773,759 | B2 | 8/2010 | Alves | |
| 7,853,031 | B2 | 12/2010 | Hamacher | |
| 8,090,120 | B2 * | 1/2012 | Seefeldt | H03G 9/14 381/104 |
| 8,238,570 | B2 * | 8/2012 | Johnson, Jr. | H04R 1/1041 381/311 |
| 8,577,677 | B2 | 11/2013 | Kim | |
| 8,611,560 | B2 | 12/2013 | Goldstein | |
| 8,625,819 | B2 | 1/2014 | Goldstein | |
| 8,682,010 | B2 | 3/2014 | Macours | |
| 9,014,378 | B2 * | 4/2015 | Chabanne | H04R 5/04 381/17 |
| 9,094,766 | B2 | 7/2015 | Merks | |
| 9,696,558 | B2 * | 7/2017 | Richards | H04N 13/324 |
| 9,877,108 | B2 * | 1/2018 | Ma | H04M 1/605 |
| 2003/0179888 | A1 | 9/2003 | Burnett | |
| 2008/0025528 | A1 * | 1/2008 | Lee | G10L 21/0364 381/94.2 |
| 2009/0274309 | A1 * | 11/2009 | Pedersen | H04S 3/00 381/56 |
| 2011/0270491 | A1 * | 11/2011 | Kincaid | B60N 2/002 701/45 |
| 2012/0106753 | A1 | 5/2012 | Theverapperuma | |
| 2013/0024194 | A1 * | 1/2013 | Zhao | G10L 21/0208 704/228 |
| 2013/0188816 | A1 | 7/2013 | Bouse | |
| 2014/0321688 | A1 | 10/2014 | Asada | |
| 2015/0179160 | A1 * | 6/2015 | Wu | H04R 3/005 381/71.8 |

* cited by examiner

CAPTURE AND EXTRACTION OF OWN VOICE SIGNAL

CROSS-REFERENCE TO RELATED APPLICATIONS

This application claims the benefit of the U.S. Provisional Application No. 62/328,841, filed Apr. 28, 2016 and also claim priority to European Patent Application No. 16162742.7, filed Mar. 30, 2016, which claims priority to International Patent Application No. PCT/CN2016/074547, filed Feb. 25, 2016, all of which are hereby incorporated by reference in their entirety.

TECHNICAL FIELD

The present disclosure relates to headsets employed in voice communications systems, and more particularly, to apparatuses, systems and methods which capture and extract a user's own voice utterances among background noise to improve voice quality.

BACKGROUND

In many important applications (e.g., operation of mobile phones or other devices to execute voice commands uttered by a headset user), it is useful to be able to reliably detect the presence or absence of vocal utterances ("own voice" content) of a headset user in the presence of background noise (e.g., to cause a speech recognition engine to start working only if and when the user's own voice is detected). In many important applications, it is also desirable to perform noise reduction on captured own voice content to reduce background noise captured with the own voice content, for example, to improve SNR (signal to noise ratio) and quality of a headset user's own voice signal. For example, such noise reduction may be employed to improve the performance of a speech recognition system in processing captured own voice content or to improve the quality of captured (and typically also transmitted) speech content.

Increasingly, mobile devices such as smart phones, laptops and the like are employing speech recognition engines. Similarly, traditional electronic devices such as household appliances, television remotes, and even automobile control interfaces are employing speech recognition engines. Further, the so-called "Internet of Things" (IoT) promises to create an opportunity to employ speech recognition engines in just about all traditional electronic devices as well as various wired/wireless sensors arrays. As such, there is a need to be able to reliably detect the presence/absence of the user's own voice among background noise, so that a speech recognition engine is employed only if the user's own voice is detected. It is also desirable to suppress background sounds in a speech recognition engine to improve (signal-to-noise) SNR and the quality of an own voice signal, so that the performance of a speech recognition system or result in improved quality of the captured/transmitted speech.

Some conventional own voice extraction headsets use near field microphone array techniques and microphones on the outside of a headset (for example, on the outside of an earplug) to perform noise cancellation. However, this requires a microphone to be placed near the user's mouth (e.g., a boom microphone). This makes the headset design bulky and prone to physical damage.

Some other conventional methods and systems use beamforming techniques, where multiple microphones on the outside of a headset form a beam pattern pointing towards the mouth of the user. However, due to the limited space on a headset (e.g., headphones), only small a microphone array is allowed, and this limits the directivity of the beam pattern and thus the performance of the noise rejection.

Other conventional methods and systems employ a headset microphone array to capture own voice content, but process the output signals of the array in a conventional manner subject to limitations and disadvantages. For example, U.S. Pat. No. 7,773,759, the content of which is incorporated herein by reference in its entirety, describes such a method and system which employs two microphones on a headset to capture own voice content. The method described in this reference employs an internal microphone (in a chamber formed at least in part by the user's ear) and an external microphone to capture the own voice content, and employs the output of the external microphone (indicative of ambient noise as well as own voice content) to compensate for high frequency loss in the own voice content captured by the internal microphone. However, this technique undesirably requires a large gain boost to compensate for the loss at high frequencies of the own voice content captured by the internal microphone, causing significant noise amplification. Also, the technique undesirably requires performance of noise reduction on the external mic signal before it is applied to perform equalization on the internal mic signal, since the external mic signal itself is noisy. Further, the simple, suppression based noise reduction employed is only suitable for reducing stationary background noise (which varies slowly or not at all in comparison with the own voice signal); not other noise (e.g., noise due to a competing talker).

Accordingly, there is a need for methods and systems to improve the processing of outputs from multiple microphones disposed in a headset (e.g., headphones) to improve own voice extraction (in the presence of ambient noise) as well as to perform own voice detection.

SUMMARY

In a first example embodiment a method is provided which captures sound using a headset having at least one earpiece including an external microphone and an internal microphone (e.g., the earpiece including the external microphone and the internal microphone). The internal microphone may be positioned in or on an internal portion of the earpiece and the external microphone may be positioned in or on an external portion of the earpiece. The method includes several steps. For example, in the presence of sound including own voice content and noise, the method generates an external microphone signal indicative of the sound as captured by the external microphone, and generates an internal microphone signal indicative of the sound as captured by the internal microphone, where the own voice content is indicative of at least one vocal utterance of a user of the headset. Another step of the method performs noise reduction on the external microphone signal, such as filtering the internal microphone signal to generate a filtered signal indicative of at least some of the noise as captured by the external microphone, and generating a noise reduced signal indicative of the own voice content by subtracting the filtered signal from the external microphone signal. The step of filtering the internal microphone signal to generate the filtered signal may correspond to application of a transfer function, InvP(z), to the internal microphone signal, wherein the transfer function, InvP(z), is equal to or at least substantially equal to an inverse of a transfer function, P(z), that represents filtering during transit through the earpiece to the internal microphone. Embodiments in this regards further provide a corresponding computer program product.

In a second example embodiment, a headset is described which includes at least one earpiece including an external microphone and an internal microphone (e.g., the earpiece including the external microphone and the internal microphone) configured to operate in the presence of sound including own voice content and noise. The internal microphone may be positioned in or on an internal portion of the earpiece and the external microphone may be positioned in or on an external portion of the earpiece. The headset is also configured to generate an external microphone signal indicative of the sound as captured by the external microphone, and to generate an internal microphone signal indicative of the sound as captured by the internal microphone. The own voice content is indicative of at least one vocal utterance of a user of the headset. The headset also coupled to an audio processing system which receives the external microphone signal and the internal microphone signal. The audio processing system is configured to perform noise reduction on the external microphone signal and the internal microphone signal to generate a noise reduced signal indicative of the own voice content. The audio processing system filters the internal microphone signal to generate a filtered signal indicative of at least some of the noise as captured by the external microphone, and generates the noise reduced signal by subtracting the filtered signal from the external microphone signal. The audio processing system may be configured to filter the internal microphone signal to generate the filtered signal in a manner corresponding to application of a transfer function, InvP(z), to the internal microphone signal, wherein the transfer function, InvP(z), is equal to or at least substantially equal to an inverse of a transfer function, P(z), that represents filtering during transit through the earpiece to the internal microphone.

In a third example embodiment, an audio processing system is provided for extracting own voice content captured by a microphone set of an earpiece of a headset. The own voice content is indicative of at least one vocal utterance of a user of the headset. The microphone set includes an external microphone and an internal microphone (e.g., the earpiece includes the external microphone and the internal microphone). The internal microphone may be positioned in or on an internal portion of the earpiece and the external microphone may be positioned in or on an external portion of the earpiece. The audio processing system further includes at least one input coupled to receive an external microphone signal indicative of output of the external microphone and an internal microphone signal indicative of output of the internal microphone. Still further, the external microphone signal and the internal microphone signal are generated with the external microphone and the internal microphone in the presence of sound including noise and the own voice content, the external microphone signal is indicative of the sound as captured by the external microphone, and the internal microphone signal is indicative of the sound as captured by the internal microphone. The audio processing system also includes a noise cancellation subsystem coupled and configured to perform noise reduction on the external microphone signal and the internal microphone signal to generate a noise reduced signal indicative of the own voice content. The audio processing system also employs filtering of the internal microphone signal to generate a filtered signal indicative of at least some of the noise as captured by the external microphone, and generate the noise reduced signal by subtracting the filtered signal from the external microphone signal. The noise cancellation subsystem may be configured to filter the internal microphone signal to generate the filtered signal in a manner corresponding to application of a transfer function, InvP(z), to the internal microphone signal, wherein the transfer function, InvP(z), is equal to or at least substantially equal to an inverse of a transfer function, P(z), that represents filtering during transit through the earpiece to the internal microphone.

In a fourth example embodiment, a tangible, computer readable medium is provided which stores, in a non-transitory manner, code for programming an audio processing system to perform processing on an external microphone signal indicative of output of an external microphone of an earpiece of a headset and an internal microphone signal indicative of output of an internal microphone of the earpiece. The internal microphone may be positioned in or on an internal portion of the earpiece and the external microphone may be positioned in or on an external portion of the earpiece. The external microphone signal and the internal microphone signal are generated with the external microphone and the internal microphone in the presence of sound including noise and own voice content. The external microphone signal is indicative of the sound as captured by the external microphone, while the internal microphone signal is indicative of the sound as captured by the internal microphone, and the own voice content is indicative of at least one vocal utterance of a user of the headset. Processing also includes a step of performing noise reduction on the external microphone signal, including by filtering the internal microphone signal to generate a filtered signal indicative of at least some of the noise as captured by the external microphone, and generating a noise reduced signal indicative of the own voice content by subtracting the filtered signal from the external microphone signal. The step of filtering the internal microphone signal to generate the filtered signal may correspond to application of a transfer function, InvP(z), to the internal microphone signal, wherein the transfer function, InvP(z), is equal to or at least substantially equal to an inverse of a transfer function, P(z), that represents filtering during transit through the earpiece to the internal microphone.

These and other embodiments and aspects are detailed below with particularity.

The foregoing and other aspects of example embodiments are further explained in the following Description, when read in conjunction with the attached Drawing Figures.

NOTATION AND NOMENCLATURE

Figure 1:
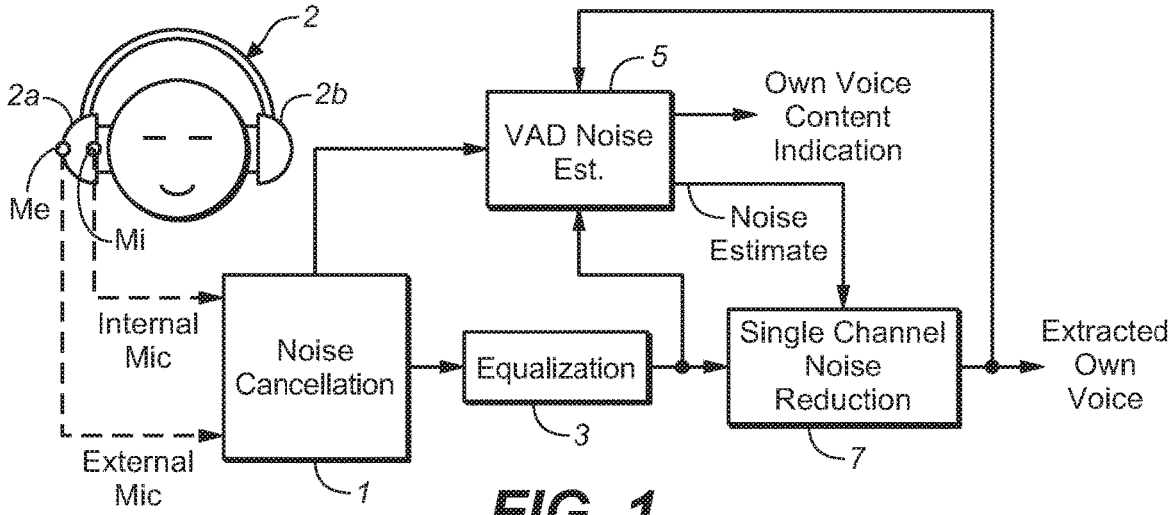
FIG. 1 is a block diagram of a system for capturing own voice signals and cancelling noise suitable for carrying out one or more example embodiments disclosed herein.

Throughout this disclosure, including in the claims, the expression performing an operation "on" a signal or data (e.g., filtering, scaling, transforming, or applying gain to, the signal or data) is used in a broad sense to denote performing the operation directly on the signal or data, or on a processed version of the signal or data (e.g., on a version of the signal that has undergone preliminary filtering or pre-processing prior to performance of the operation thereon).

Throughout this disclosure including in the claims, the expression "system" is used in a broad sense to denote a device, system, or subsystem. For example, a subsystem that implements processing may be referred to as a processing system, and a system including such a subsystem (e.g., a system that generates multiple output signals in response to X inputs, in which the subsystem generates M of the inputs and the other X-M inputs are received from an external source) may also be referred to as a processing system.

Throughout this disclosure including in the claims, the term "processor" is used in a broad sense to denote a system or device programmable or otherwise configurable (e.g., with software or firmware) to perform operations on data (e.g., audio, or video or other image data). Examples of processors include a field-programmable gate array (or other configurable integrated circuit or chip set), a digital signal processor programmed and/or otherwise configured to perform pipelined processing on audio or other sound data, a programmable general purpose processor or computer, and a programmable microprocessor chip or chip set.

Throughout this disclosure including in the claims, the term "couples" or "coupled" is used to mean either a direct or indirect connection. Thus, if a first device couples to a second device, that connection may be through a direct connection, or through an indirect connection via other devices and connections.

Throughout this disclosure, including in the claims, the expression "headset" denotes an apparatus configured to be worn on or positioned against a user's head. Examples of headsets are audio headphones (of the type that include a loudspeaker for each ear of the user) and telephone headsets (of the type including a microphone, and either a loudspeaker for each ear or a single loudspeaker for one ear of the user).

Throughout this disclosure, including in the claims, the expression "ear piece" (or "earpiece") denotes a subassembly (or portion) of a headset, intended and configured to be positioned in, or otherwise in direct contact with, an ear of the headset's user. An example of an ear piece is an "ear cup" of a headset (designed to be positioned in direct contact with, but outside of, an ear of the headset's user, and including a small loudspeaker). Another example of an ear piece is an "earbud" of a headset (designed to be positioned in the ear canal of an ear of the headset's user, and including a small loudspeaker).

Throughout this disclosure, including in the claims, the expression "inside portion" of an earpiece denotes a subassembly (or portion) of an earpiece, intended and configured to be positioned in direct contact with (e.g., in) an ear of a headset user, and the expression "outside portion" of an earpiece denotes a subassembly (or portion) of an earpiece which is separated from the inside portion of the earpiece by an acoustically isolating middle portion of the earpiece. Thus, the outside portion of an earpiece (of a headset) is acoustically isolated from the inside portion of the earpiece (and, in use, is acoustically isolated from the ear canal of the headset user). In this context, acoustic isolation does not denote total acoustic isolation, but instead denotes acoustic isolation characterized by a transfer function, P(z), such that S2=P(z)S1, where S1 is a frequency domain representation of an acoustic signal incident at a first portion of the earpiece (either the inside portion or the outside portion of the earpiece), and S2 is a frequency domain representation of the acoustic signal after transmission through the earpiece to a second portion of the earpiece (the other one of the inside portion or outside portion of the earpiece), where S1 and S2 are frequency domain representations of discrete-time signals (each determined by a z-transform of the corresponding discrete-time signal).

Herein, the term "mic" is used for convenience to denote "microphone."

Description of Example Embodiments

The example embodiments described herein recognize that capture of and performance of noise reduction on own voice content (indicative of vocal utterances of a headset user) can be better achieved by processing the outputs of multiple microphones included in the headset. For example, example embodiments disclose apparatuses, methods and systems which improve processing of outputs of multiple microphones of a headset (e.g., headphones) to improve own voice extraction (in the presence of ambient noise). In another example embodiments, apparatuses, methods and systems also perform own voice detection.

The present disclosure relates to apparatuses, systems and methods which capture and extract vocal utterances by a headset user ("own voice" audio content) among background noise, e.g., to improve voice quality. Some embodiments include steps of employing an internal microphone and an external microphone of a headset to capture own voice content, performing noise reduction on the microphone outputs to generate a noise reduced signal indicative of the own voice content, and optionally also performing voice activity detection to identify time segments of own voice presence and/or absence.

In some embodiments, the invention is (or is performed during operation of) a headset having at least one earpiece (i.e., one earpiece or two earpieces) equipped with an internal microphone and an external microphone. Herein, "internal microphone" (or "internal mic") denotes a microphone positioned in or on an inside portion of an earpiece (e.g., so that during use of the headset, the internal microphone faces the user's ear or is at least partially within the user's ear canal), and "external microphone" (or "external mic") denotes a microphone positioned in or on an outside portion of an earpiece, so that the external microphone is acoustically isolated (as defined above) from an internal microphone of the earpiece (and, during use of the headset, is acoustically isolated from the user's ear). In some embodiments, the earpiece is an ear cup. In some other embodiments, the earpiece is an earbud. In a typical noisy environment, when the user speaks, the external mic captures a combination of ambient noise and the user's voice (sometimes referred to as "own voice"), and the internal mic captures low-pass filtered ambient noise (due to isolation provided by the earpiece) and a bone/flesh/air conducted signal (transmitted through bone, flesh, and air) indicative of the own voice.

In some embodiments, the invention is a method which captures own voice content (indicative of vocal utterances, e.g., speech, of a user of a headset) using an internal microphone and an external microphone of the headset, and performs noise reduction on the output signals of the microphones to generate a noise reduced signal indicative of the own voice content (and optionally also performs equalization and residual noise reduction on the noise reduced signal). In such embodiments, the external mic is employed to capture the own voice content (the external mic output signal contains the full bandwidth of the own voice content), and the internal mic output signal is employed to infer the noise captured by the external mic. The inferred noise is subtracted from the external mic signal to generate the noise reduced signal. In typical implementations, the noise reduced signal (e.g., after equalization has been, or both equalization and residual noise reduction have been, performed thereon) is a very good quality own voice signal from which there has been a huge reduction of background noise (e.g., dynamic sounds, and speech which is not own voice content).

In a first class of embodiments, the inventive method captures sound using a headset having at least one earpiece including an external microphone and an internal microphone, wherein the sound includes own voice content (indicative of at least one vocal utterance of a user of the headset), and includes steps of:

(a) in the presence of sound including own voice content (indicative of at least one vocal utterance of a user of the headset) and noise, generating an external microphone signal indicative of the sound as captured by the external microphone, and generating an internal microphone signal indicative of the sound as captured by the internal microphone; and (b) performing noise reduction on the external microphone signal, including by filtering the internal microphone signal to generate a filtered signal indicative of at least some of the noise (e.g., coherent ambient sound, other than the own voice content) captured by the external microphone, and subtracting the filtered signal from the external microphone signal to generate a noise reduced signal indicative of the own voice content.

The filtered signal is typically also indicative of a filtered version of the own voice content captured by the internal microphone, and the subtraction may cause coloring of the own voice signal. So, the method optionally also includes a step of performing equalization on the noise reduced signal (to reduce distortion of captured own voice content, including that caused by subtracting the filtered signal from the external microphone signal) thereby generating an equalized noise reduced signal, and optionally also a step of performing residual noise reduction on the equalized noise reduced signal.

In typical implementations, the subtraction of the filtered signal from the external microphone signal removes most of the coherent ambient noise from the external microphone signal (and passes through own voice content so that the noise reduced signal is indicative of the own voice content), but the noise reduced signal and the equalized noise reduced signal are indicative of at least some incoherent (e.g., diffuse) noise captured by the external microphone. Thus, in some such implementations, a second-stage of noise reduction (i.e., residual noise reduction, sometimes referred to herein as single channel noise reduction) is performed so as to remove at least some of the incoherent noise from the equalized noise reduced signal.

In some embodiments, the performance of single channel noise reduction on the equalized noise reduced signal uses a noise estimate determined by a voice activity detector (e.g., an estimate of the frequency-amplitude spectrum of incoherent noise, determined at times between time segments of own voice activity). Such a noise estimate can be used in order to continuously reduce (e.g., both during and between time segments of own voice activity) incoherent noise from the equalized noise reduced signal. In some embodiments, the voice activity detector is configured to perform own voice detection in accordance with one of the below-described method steps.

In some embodiments in the first class, the inventive method also includes steps of:

(c) comparing power of the noise reduced signal (or the equalized noise reduced signal) and power of the external microphone signal, on a frame by frame basis, and identifying each frame (of the noise reduced signal or the equalized noise reduced signal) whose power is much smaller than the power of the corresponding frame of the external microphone signal as an own-voice absent frame (since most audio content indicated by the frame of the external microphone signal must be ambient sound, so that the power of the corresponding frame of the noise reduced signal or equalized noise reduced signal is greatly reduced by the noise reduction), and identifying each frame (of the noise reduced signal or the equalized noise reduced signal) whose power is not much smaller than the power of the corresponding frame of the external microphone signal as an own-voice frame (which is indicative of a significant own-voice component on which noise reduction has been performed to generate the noise reduced signal, and which corresponds to a time segment of own voice activity). These steps can be performed by the above-mentioned voice activity detector.

In some other embodiments in the first class, the inventive method also includes steps of:

(c) comparing levels of frequency components of time segments of the internal microphone signal and levels of frequency components of corresponding time segments of the external microphone signal (e.g., by applying a low complexity spectral analysis algorithm) in a low frequency range (e.g., a range from a frequency at least substantially equal to 100 Hz to a frequency at least substantially equal to 500 Hz), determining that each time segment of the internal microphone signal and the external microphone signal in which the levels of the frequency components of the internal microphone signal are higher (e.g., that an average or envelope of the levels is higher) than the levels of the frequency components (e.g., an average or envelope of the levels) of the external microphone signal (in the low frequency range) is indicative of own voice activity, and determining that each time segment of the internal microphone signal and the external microphone signal in which the levels of the frequency components of the internal microphone signal are not higher (e.g., that an average or envelope of the levels is not higher) than the levels of the frequency components (e.g., an average or envelope of the levels) of the external microphone signal (in the low frequency range) is not indicative of own voice activity. These steps too can be performed by the above-mentioned voice activity detector.

Aspects of embodiments of the invention include methods performed by any embodiment of the inventive system, a system or device configured (e.g., programmed) to perform any embodiment of the inventive method (e.g., a headset including an audio processing subsystem configured to perform an embodiment of the inventive method), and a computer readable medium (e.g., a disc or other tangible storage medium) which stores code (e.g., in a non-transitory manner) for implementing any embodiment of the inventive method or steps thereof. For example, the inventive system can be or include a programmable general purpose processor, digital signal processor, or microprocessor, programmed with software or firmware and/or otherwise configured to perform any of a variety of operations on data, including an embodiment of the inventive method or steps thereof. Such a general purpose processor may be or include a computer system including an input device, a memory, and processing circuitry programmed (and/or otherwise configured) to perform an embodiment of the inventive method (or steps thereof) in response to data asserted thereto.

FIG. 1 is a block diagram of an embodiment of the inventive system, including headset 2 including earpieces 2*a* and 2*b*. Earpiece 2*a* includes an external microphone, Me, and an internal microphone, Mi. External microphone Me is mounted in or on an outside portion of earpiece 2*a*, and internal microphone Mi is mounted in or on an inside portion of earpiece 2*a*. Headset 2 includes an audio processor (sometimes referred to herein as an audio processing system) including noise cancellation subsystem 1 (having inputs coupled to external microphone Me and internal microphone Mi, as shown), equalization subsystem 3, single channel noise reduction subsystem 7, and voice activity detection (VAD) and noise estimation subsystem 5, coupled as shown (and optionally also additional elements not shown). Alternatively, the audio processor is coupled to, but not included in, headset 2 (e.g., subsystem 1 of the audio processor has inputs coupled by a wireless link to external microphone Me and internal microphone Mi).

In typical implementations of the FIG. 1 system (and some other embodiments of the invention), the special microphone configuration of a headset (e.g., headset 2 implemented as headphones) and the method for processing the microphone output signals exploit the acoustic properties of coupling between the headset, the ear canal of the headset's user, and the microphones in order to extract user "own voice" content from background noise (e.g., a high level of background noise) and typically also to provide good quality voice detection simultaneously with the own voice extraction.

In some implementations, headset 2 is a set of headphones, the external microphone Me is mounted on the outside of earpiece 2*a* (implemented as an ear cup or earbud) and facing outward (away from the user), and the internal microphone Mi is mounted on the inside of earpiece 2*a* facing the user's ear canal. In a typical noisy environment, when the user starts speaking, the external mic Me picks up a combination of ambient noise and the user's voice, and the internal mic Mi picks up low-pass filtered ambient noise (due to the earcup/earbud isolation) and a bone/flesh/air conducted own voice signal.

Figure 2:
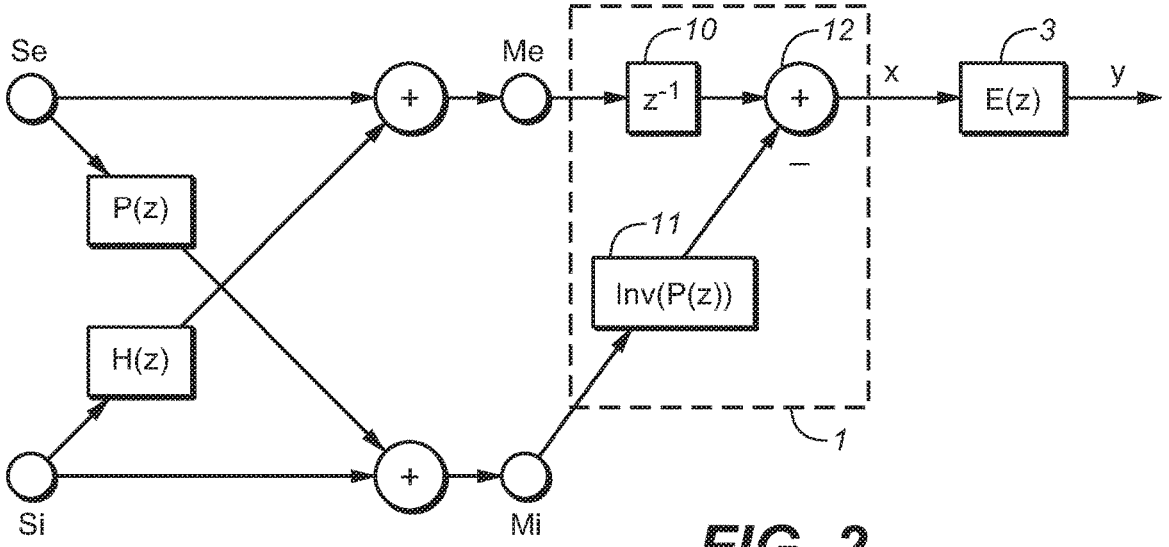
FIG. 2 illustrates the noise cancellation subsystem and equalization subsystem shown in FIG. 1.

In the FIG. 1 system, extraction of own voice content from background noise has two processing stages. A first-stage signal processing unit (subsystem 1 of FIG. 1, e.g., implemented as shown in FIG. 2) is provided the external and internal microphone signals as input and performs noise cancellation thereon to remove most of the coherent ambient sound while passing through the own voice content. An equalizer (equalization subsystem 3 of FIG. 1 or FIG. 2) then restores the frequency-amplitude spectrum of the own voice signal, which had been distorted by the noise cancellation process. The second-stage processing (e.g., in subsystem 7 of FIG. 1) employs a single channel noise reduction method to remove remaining incoherent noise from the extracted own voice content. The single channel noise reduction method may use a voice activity detector (e.g., VAD and noise estimation subsystem 5 of FIG. 1) to estimate the noise spectrum which is to be reduced continuously.

Each of the microphone signals consists of audio data (a sequence of audio data samples), or subsystem 1 samples each microphone signal to generate such audio data. As required, one or more of subsystems 1, 3, 5, and/or 7 implements a time domain-to-frequency domain transform on time domain data (e.g., a sequence of samples of a microphone signal) to generate frequency domain data indicative of frequency components to be processed (e.g., filtered) in the frequency domain, and implements a frequency domain-to-time domain transform on the output(s) of such processing.

More specifically, in operation of the FIG. 1 system, microphones Me and Mi capture sound, including own voice content (indicative of at least one vocal utterance of, e.g., speech uttered by, a user of headset 2) and noise. In the presence of the sound, microphone Me generates an external microphone signal indicative of the sound as captured by microphone Me, and microphone Mi generates an internal microphone signal indicative of the sound as captured by microphone Mi. The external microphone signal and internal microphone signal are provided to noise cancellation subsystem 1.

Noise cancellation subsystem 1 is configured to (e.g., is, or is included in, an audio processor programmed to) perform noise reduction on the external microphone signal and the internal microphone signal, including by filtering the internal microphone signal to generate a filtered signal indicative of at least some of the noise (e.g., coherent ambient sound other than the own voice content) captured by the external microphone, and subtracting the filtered signal from the external microphone signal to generate a noise reduced signal indicative of the own voice content. The noise reduced signal is provided to equalization subsystem 3.

Example embodiments of subsystem 1 will be described below in greater detail with reference to FIG. 2.

Since the above-mentioned filtered signal is typically also indicative of a filtered version of the own voice content captured by the internal microphone, equalization subsystem 3 is configured to perform equalization on the noise reduced signal output from subsystem 1, to reduce distortion of captured own voice content (e.g., distortion caused by subtraction in subsystem 1 of the filtered signal from the external microphone signal), thereby generating an equalized noise reduced signal.

The equalized noise reduced signal is provided to subsystem 7. The subtraction of the filtered signal from the external microphone signal (in typical implementations of subsystem 1) removes most of the coherent ambient noise from the external microphone signal but passes through own voice content so that the noise reduced signal indicative of the own voice content. Thus, subsystem 7 is configured to perform residual noise reduction (sometimes referred to herein as single channel noise reduction) on the equalized noise reduced signal to remove remaining incoherent (e.g., diffuse) noise from the equalized noise reduced signal. Typically, the single channel noise reduction uses an estimate of the incoherent noise generated by voice activity detection (VAD) and noise estimation subsystem 5.

More specifically, in some embodiments, VAD and noise estimation subsystem 5 generates (and provides to subsystem 7) a noise estimate, which is typically an estimate of the frequency-amplitude spectrum of incoherent noise of the equalized noise reduced signal output from equalizer 3. This noise estimate is determined at times between time segments of own voice activity. Subsystem 5 is also configured to perform voice activity detection (e.g., in accordance with one of the methods described herein), and as a result, to generate an indication of whether each segment of the equalized noise reduced signal is or is not a segment of own voice activity. The noise estimate generated by subsystem 5 (from segments of own voice activity of the equalized noise reduced signal) can be used by subsystem 7 to continuously (e.g., both during and between segments of own voice activity) reduce incoherent noise from the equalized noise reduced signal.

In some alternative embodiments, a variation on subsystem 5 is configured only to perform voice activity detection and as a result, to generate an indication of whether each segment of the equalized noise reduced signal is or is not a segment of own voice activity (i.e., this variation on subsystem 5 is not configured to generate a noise estimate). In such embodiments, subsystem 7 may itself (or another subsystem may) generate each noise estimate needed for subsystem 7 to perform residual noise reduction on the output of equalizer 3 (e.g., in response to an own voice content activity indication received from the variation on subsystem 5).

In some other alternative embodiments, a variation on subsystem 5 is not configured to perform voice activity detection (i.e., is not configured to generate an indication of whether each segment of the equalized noise reduced signal is or is not a segment of own voice activity) and instead is configured only to generate a noise estimate. In such embodiments, subsystem 7 may use the noise estimate to perform residual noise reduction on the output of equalizer 3.

In some implementations, subsystem 5 of the audio processor of FIG. 1 is configured to perform own voice activity detection as follows, to generate an indication of whether each segment of the equalized noise reduced signal is or is not a segment of own voice activity. In some such implementations, subsystem 5 is coupled to receive the equalized noise reduced signal output from subsystem 3 (or the noise reduced signal output from subsystem 1) and the external microphone signal (output from microphone Me), and is configured to compare the power of the equalized noise reduced signal (or the noise reduced signal) and power of the external microphone signal on a frame by frame basis. Each frame (of the noise reduced signal or the equalized noise reduced signal) whose power is much smaller than the power of the corresponding frame of the external microphone signal, is identified as an own-voice absent frame (since most audio content indicated by the frame of the external microphone signal must be ambient sound, so that the power of the corresponding frame of the noise reduced signal or equalized noise reduced signal is greatly reduced by the noise reduction). Each frame (of the noise reduced signal or the equalized noise reduced signal) whose power is not much smaller than the power of the corresponding frame of the external microphone signal, is identified as an own-voice frame which is indicative of a significant own-voice component (on which noise reduction has been performed to generate the noise reduced signal). Such an implementation of subsystem 5 is configured to output a signal (identified in FIG. 1 as an own voice content indication) indicating whether each frame of the external microphone signal (and the corresponding frame of the noise reduced signal or equalized noise reduced signal) is or is not indicative of own voice content.

When a user wearing a headset speaks, the user hears that his or her own voice is boosted at low frequencies (typically under 500 Hz) due to the fact that the ear is occluded by the earpiece (e.g., ear cup or earbud). This is called the occlusion effect. In operation of the FIG. 1 system, the internal microphone, Mi, captures occluded own voice content and the external microphone, Me, captures the normal (non-occluded) own voice content.

Thus, in some implementations, subsystem 5 of the audio processor of FIG. 1 is configured to perform own voice activity detection as follows, to generate an indication of whether each segment of the equalized noise reduced signal is or is not a segment of own voice activity. In some such implementations, subsystem 5 is coupled and configured to compare levels of frequency components of the internal microphone signal and levels of frequency components of the external microphone signal (e.g., by applying a low complexity spectral analysis algorithm) in a low frequency range (e.g., a range from 100 Hz to 500 Hz)), and to determine that the internal microphone signal and the external microphone signal are indicative of own voice content upon determining that the levels of the frequency components of the internal microphone signal are higher (e.g., that an average or envelope of the levels is higher) than the levels of the frequency components (e.g., an average of the levels) of the external microphone signal. Conversely, such an implementation of subsystem 5 is configured so that, upon determining that the levels of the frequency components of the internal microphone signal are not higher (e.g., that an average or envelope of the levels is not higher) than the levels of the frequency components (e.g., an average or envelope of the levels) of the external microphone signal in the low frequency range, it determines that the internal microphone signal and the external microphone signal are not indicative of own voice content. Such an implementation of subsystem 5 is configured to output a signal (identified in FIG. 1 as an own voice content indication) indicating whether the external microphone signal (or a frame or other segment thereof) is or is not indicative of own voice content.

It should be appreciated that there is typically a small amount of incoherent noise (e.g., microphone noise) that cannot be canceled by subsystem 1. Thus, a second stage of noise reduction may be performed to reduce this incoherent noise. For example, this second stage can be single channel noise reduction (e.g., application of a Wiener filter implemented by subsystem 7 of FIG. 1, or spectral subtraction, or another method) performed to remove the incoherent (e.g., diffuse) noise. Such a second stage of noise reduction typically requires an estimate of the noise spectrum to be reduced, and the noise spectrum typically needs to be estimated during pauses between vocal utterances by the headset user. This requires voice activity detection (VAD) and preferably a simple and robust implementation of VAD. As described above, one can obtain (using the output of a typical implementation of noise cancelling subsystem 1) a very noise robust VAD by comparing the level of the noise reduced signal output from subsystem 1 (or the equalized version thereof output from subsystem 3) with the originally captured noisy signal. If there is a large difference between these two signals, it is determined that the originally captured signal is ambient noise dominant (own voice absent), since most of the originally captured signal is canceled out by operation of subsystem 1. Otherwise, it is determined that the originally captured signal is own voice dominant.

It should be appreciated that ambient sounds reach the two microphones (Me and Mi) with a difference that can be characterized by a transfer function TFa, and own voice content reaches the two microphones with a difference that can be characterized by a transfer function TFo. The noise cancellation performed in accordance with typical embodiments (e.g., by subsystem 1 of FIG. 1) exploits the fact that TFo is always very different than TFa, since the own voice travels through bone, flesh, and air to reach the internal microphone (e.g., in or facing the ear canal) and an airborne path to the external microphone, while the ambient noise takes an airborne path to the external microphone (and then an additional path through the earpiece to the internal microphone). Thus, when the FIG. 2 system subtracts an estimate of ambient noise from the external microphone signal, the ambient noise is removed while the own voice is only filtered (e.g., in a manner resulting in timbre changes). Equalization subsystem 3 is configured to compensate for this filtering (e.g., to an extent which is practical to achieve) to restore the own voice signal spectrum (e.g., timbre).

FIG. 2 is a diagram of a portion of the FIG. 1 system (including an embodiment of noise cancellation subsystem 1 of FIG. 1, and external microphone Me, internal microphone Mi, and subsystem 3 of FIG. 1) and of signals captured and generated thereby.

In the FIG. 2 system:

signal "Si" is occluded "own voice" content (a vocal utterance of the headset user, including a portion transmitted through an earpiece of the headset into the ear canal, and a portion transmitted through part of the user's body into the ear canal, where the ear canal is closed by the earpiece, and suffering the occlusion effect) as sensed and captured by internal microphone Mi of earpiece 2*a;* signal "H(z)Si" is normal (non-occluded) "own voice" content as sensed and captured by external microphone Me of earpiece 2*a*, which corresponds to the occluded own voice content Si after filtering by transfer function H(z). Transfer function H(z) is the inverse of a transfer function characterizing the occlusion distortion introduced by transmission through the earpiece and the portion of the user's body;

signal "Se" is ambient sound (noise originating from one or more sources external to the headset user, e.g., speech by a person other than the headset user) as sensed and captured by external microphone Me of earpiece 2*a*; and signal "P(z)Se" is the ambient sound as sensed and captured by internal microphone Mi of earpiece 2*a*, which corresponds to the sound Se after undergoing filtering by transfer function P(z) during transit through the earpiece to microphone Mi.

Figure 4:
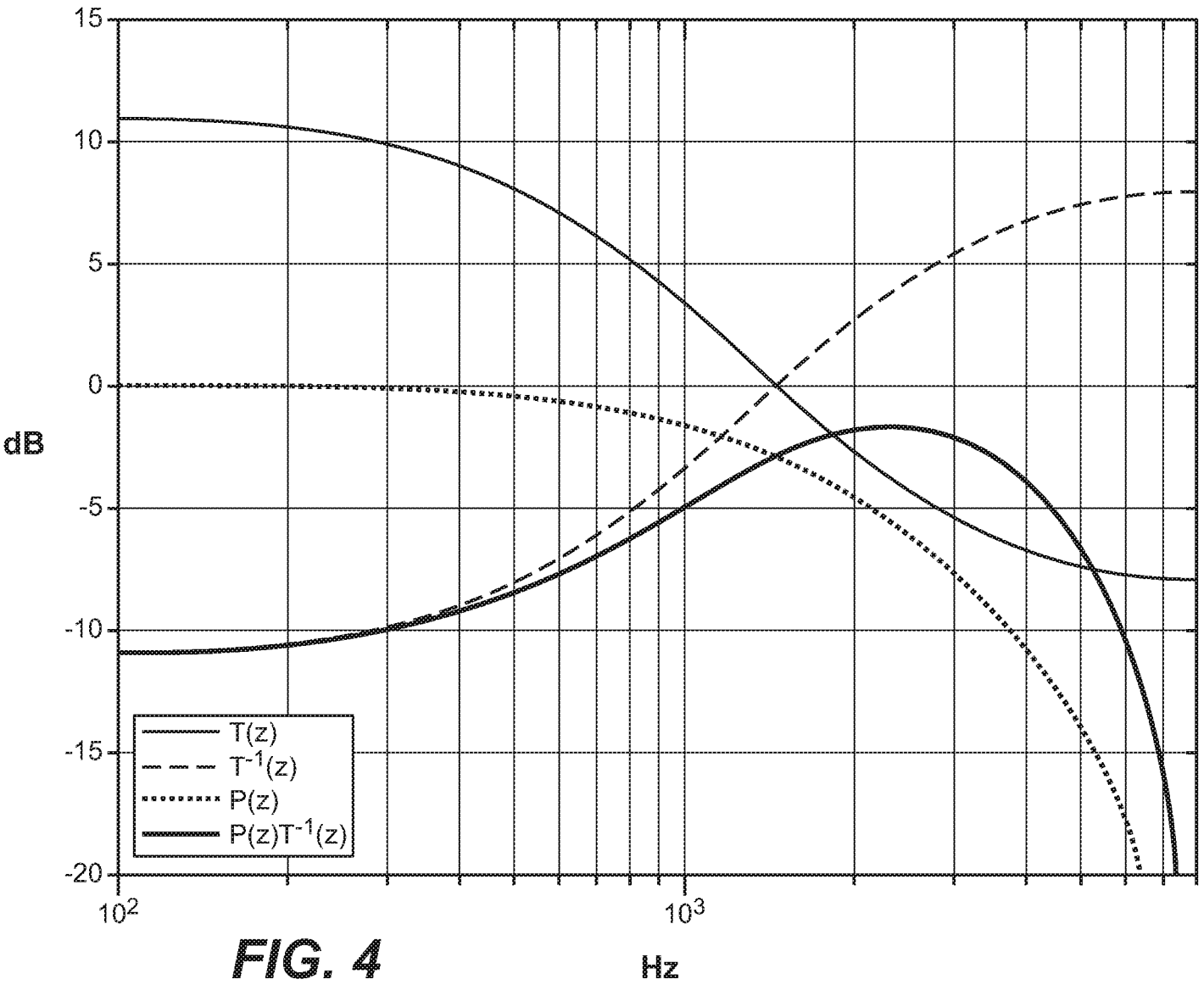
FIG. 4 is a graph of examples of transfer functions of types which are assumed and/or applied in accordance with some example embodiments of the invention.

Signal "Si" can be seen as a sum of two parts: the own voice utterance from the mouth transmitted through the air and the earpiece to the internal microphone (represented by the transfer function P(z)), and the own voice utterance from the mouth transmitted through flesh and bones to the occluded ear canal (e.g., represented by transfer function T(z) of FIG. 4). The entrance of the ear canal is occluded by the earpiece which stops the sound pressure from leaving the ear canal and thus effectively boosts the low frequency of the own voice (e.g., by up to 30 dB). This is known as the occlusion effect.

As indicated in FIG. 2, the output of the external microphone, Me, is equivalent to the sum of the ambient sound signal, Se, and the filtered version, H(z)Si, of the occluded own voice content (Si), and the output of internal microphone, Mi, is equivalent to the sum of signal Si, and the filtered version, P(z)Se, of the ambient sound signal, Se. As indicated in FIG. 2, both the internal microphone Mi and the external microphone Me capture own voice content (Si or H(z)Si) and ambient noise (P(z)Se or Se). The external microphone, Me, captures the ambient sound, Se, which is considered as noise to be reduced in accordance with an aspect of example embodiments of the invention. The external microphone also captures a non-occluded version of the own voice, H(z)Si, that contains the full bandwidth of the own voice. The output of the internal microphone, Mi, is processed to generate an inferred version of the noise Se.

Delay stage 10, filter 11, and subtraction stage 12, coupled as shown in FIG. 2, are an embodiment of noise cancellation subsystem 1 of FIG. 1. The output of stage 12 is provided to equalization subsystem 3.

In FIG. 2, filter 11 is configured so that the filtering it performs on the internal microphone signal (sometimes referred to herein as "M") output from internal microphone, Mi, corresponds to application of a transfer function Inv(P(z))=$P^{-1}$(z), or a transfer function at least substantially equal to $P^{-1}$(z), to the internal microphone signal M, where $P^{-1}$(z) is the inverse of above-described transfer function, P(z).

In FIG. 2, delay stage 10 (labeled $Z^{-1}$) in a first branch of the system (between microphone Me and element 12) is configured to introduce delay which compensates for the delay introduced in the other branch of the system (between microphone Mi and element 12) by application (in filter 11) of the "Inv(Pz))" filter.

Subtraction stage 12 is configured to subtract the filtered output of filter 11 (the signal "InvP(z)Si+InvP(z)P(z)Se") from the external microphone signal ("Se+H(z)Si").

Equalization subsystem 3 is coupled and configured to perform equalization (corresponding to application of transfer function "E(z)") on the noise reduced signal output from element 12. The noise reduced signal is Se+H(z)Si−[InvP(z)Si+InvP(z)P(z)Se], which is at least substantially equal to H(z)Si−InvP(z)Si.

In typical embodiments, the function of equalization subsystem ("equalizer") 3 is to output a signal whose amplitude (as a function of time) is proportional to H(z)Si, in response to its input signal, which is at least substantially equal to the difference signal H(z)Si−InvP(z)Si. Ideally, the output of equalizer 3 should be at least substantially equal to (e.g., a close approximation of) gH(z)Si, where g is a gain.

Thus, the filter applied by equalizer 3 ideally takes the form: E(z)=H(z)/(H(z)−Inv(P(z))). However, the inventor has recognized that this ideal implementation may be an unstable IIR filter. Thus, some embodiments of the invention implement equalizer 3 as a stable approximation of the ideal equalization filter.

Elements 1 and 3 of the FIG. 2 (or FIG. 1) system can be implemented in either the time domain or in the frequency domain. The second stage of noise reduction (subsystem 7 of FIG. 1) which operates on the output of equalizer 3 is typically implemented in frequency domain.

In some embodiments, equalizer 3 of FIG. 2 is implemented to apply an equalization filter E(z) determined as follows. Initially, it should be recognized that:

$$X=Me-P^{-1}(z)Mi, \tag{1}$$

$$Mi=Si+P(z)Se, \tag{2}$$

and $$Me=Se+H(z)Si, \tag{3}$$

where Mi is the output signal of the internal microphone (also referred to as microphone Mi), Me is the output signal of the external microphone (also referred to as microphone Me), X is the signal input to equalizer 3 (i.e., the signal output from subtraction element 12 of FIG. 2), and $P^{-1}$(z)=Inv P(z) is the filter applied to the internal microphone output signal Mi by filter element 11.

Combining equations (1), (2), and (3), it is apparent that $$X=H(z)Si-P^{-1}(z)Si=d-P^{-1}(z)Si, \tag{4}$$

where "d" denotes the signal "H(z)Si."

The signal, d=H(z)Si, which is the first term on the right side of Equation (4) is exactly the desired own voice signal (without occlusion distortion, and measured at the external mic, Me, in the absence of ambient noise).

The signal Si, by definition, consists of two parts: the desired signal after transmission through an airborne path attenuated by the headset's acoustic isolation (above-mentioned transfer function "P(z)") and the desired signal after transmission along a path through the user's head (equivalent to filtering of signal d=H(z)Si by a transfer function "T(z)" implementing the head transmission with occlusion effect):

$$Si=P(z)d+T(z)d, \tag{5}$$

where "d" denotes the signal "H(z)Si."

The optimal equalizer E(z) for restoring the desired signal, d=H(z)Si, from signal X is determined from the relation Y=E(z)X=gd, where g is a gain factor. Combining equations (4) and (5), we identify the optimal equalizer, E(z) for restoring the desired signal, d=H(z)Si, with gain factor g=−1, as $$E(z)=P(z)T^{-1}(z). \tag{6}$$

I.e., E(z)=P(z)InvT(z), where InvT(z)=$T^{-1}$(z) denotes the inverse of T(z). To implement equalizer 3 of FIG. 2 to apply an equalization function which satisfies equation (6), the function P(z) can be estimated from the microphone signals Me and Mi using a test signal as the signal Se, and the function T(z) can be estimated from the microphone signals Me and Mi with the user's own voice as the signal Si.

In a preferred embodiment, equalizer 3 of FIG. 2 is implemented to apply an equalization function E(z) determined as result of recognizing that P(z) is a low-pass filter due to the attenuation by the earpiece (e.g., as shown in FIG. 4), and T(z) has a low-frequency boost and high frequency roll-off (e.g., as shown in FIG. 4). With this recognition, the E(z) is determined to be at least substantially equal to P(z)$T^{-1}$(z) as shown in FIG. 4, in accordance with equation (6).

What follows is an explanation as to how transfer function InvP(z), the inverse of transfer function P(z), which is applied by filter 11 of FIG. 2 can be estimated directly without knowledge of the transfer function P(z). Let D(z) =Inv(P(z)) for clarity in the explanation. It is apparent from FIG. 2 that D(z) is actually a transfer function that matches the internal microphone signal to the external microphone signal, when there is only one source, Se.

Thus, one example embodiment of a method for estimating transfer function D(z) determines a time varying estimate of D(z). In this example, one uses an adaptive filter such as an LMS filter, with the internal microphone signal (Mi) as the input and the external microphone signal (Me) as the reference, to obtain the estimate of D(z) during an own-voice-absent time interval. This estimate can be updated frequently whenever own voice content is absent.

Another example embodiment of a method for estimating transfer function D(z)=Inv(P(z)) includes a step of pre-measuring D(z), and then uses the pre-measured D(z) as a constant in the noise cancellation method implemented by elements 10, 11, and 12 of FIG. 2. Due to the small distance between the external mic Me and the internal mic Mi (e.g., there is typically about 1 cm of spacing between Me and Mi), any frequency components of sound lower than about 8 kHz (¼ wavelength) will appear to be almost in phase at the two microphones, regardless of from which direction the sound comes from. Therefore, it is possible to pre-measure the transfer function D(z) with a test signal from an arbitrary direction, or even with a diffuse test signal, and then use the estimate in noise cancellation on any other signal.

It is contemplated that embodiments of the inventive method and system can be included in (or performed by) any of a wide variety of devices and systems, for example:

Next generation headphone/smart headphones. These are typically equipped with DSPs and various sensors (mics) and are designed to do much more than just play back music. They will typically have a conversation mode that allows a user talk to others during media playback, where the user's own voice is part of the conversation;

Augmented reality headphones that make a user's own voice sounds natural, and thus need to be able to extract own voice content from ambient sounds;

Gaming headphones which enable communications between gamers; and

Bluetooth headsets that fit completely in the ear canal.

Another aspect of some embodiments of the invention is an audio processor (sometimes referred to herein as an audio processing system) configured to perform any embodiment of the inventive method. For example, one such audio processor includes noise cancellation subsystem 1 (configured to be coupled to external microphone Me and internal microphone Mi to receive output signals thereof), equalization subsystem 3, single channel noise reduction subsystem 7, and voice activity detection (VAD) and noise estimation subsystem 5 of FIG. 2. Another example embodiment of the audio processor is or includes noise cancellation subsystem 1 (configured to be coupled to external microphone Me and internal microphone Mi to receive output signals thereof), and optionally also equalization subsystem 3 and single channel noise reduction subsystem 7 (but not subsystem 5), of FIG. 2.

Embodiments of the present invention may be implemented in hardware, firmware, or software, or a combination thereof. For example, subsystems 1, 3, 5, and 7 of FIG. 1 may be implemented in appropriately programmed (or otherwise configured) hardware or firmware, e.g., as a programmed general purpose processor, digital signal processor, or microprocessor. Unless otherwise specified, the algorithms or processes included as part of embodiments of the invention are not inherently related to any particular computer or other apparatus. In particular, various general-purpose machines may be used with programs written in accordance with the teachings herein, or it may be more convenient to construct more specialized apparatus (e.g., integrated circuits) to perform the required method steps. Thus, the point of interest selection, audio signal processing, mixing, and audio program generation operations of embodiments of the invention may be implemented in one or more computer programs executing on one or more programmable computer systems, each including at least one processor, at least one data storage system (including volatile and non-volatile memory and/or storage elements), at least one input device or port, and at least one output device or port. Program code is applied to input data to perform the functions described herein and generate output information. The output information is applied to one or more output devices, in known fashion.

Each such program may be implemented in any desired computer language (including machine, assembly, or high level procedural, logical, or object oriented programming languages) to communicate with a computer system. In any case, the language may be a compiled or interpreted language.

For example, when implemented by computer software instruction sequences, various functions and steps of embodiments of the invention may be implemented by multithreaded software instruction sequences running in suitable digital signal processing hardware, in which case the various devices, steps, and functions of the embodiments may correspond to portions of the software instructions.

Each such computer program is preferably stored on or downloaded to a storage media or device (e.g., solid state memory or media, or magnetic or optical media) readable by a general or special purpose programmable computer, for configuring and operating the computer when the storage media or device is read by the computer system to perform the procedures described herein. The inventive system may also be implemented as a computer-readable storage medium, configured with (i.e., storing in a non-transitory manner) a computer program, where the storage medium so configured causes a computer system to operate in a specific and predefined manner to perform the functions described herein.

Figure 3:
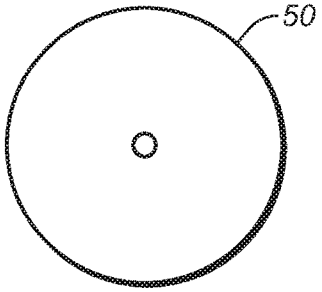
FIG. 3 is a computer readable medium (for example, a disc or other tangible storage medium) which stores code suitable for carrying out one or more example embodiments disclosed herein.

For example, an example embodiment of the invention is computer readable medium 50 of FIG. 3 (e.g., a disc or other tangible storage medium) which stores code (e.g., in a non-transitory manner) for implementing any embodiment of the inventive method or steps thereof.

Example embodiments (EEEs) including the following:

EEE 1. A method for capturing sound using a headset having at least one earpiece including an external microphone and an internal microphone, said method including steps of:

in the presence of sound including own voice content and noise, generating an external microphone signal indicative of the sound as captured by the external microphone, and generating an internal microphone signal indicative of the sound as captured by the internal microphone, where the own voice content is indicative of at least one vocal utterance of a user of the headset; and performing noise reduction on the external microphone signal, including by filtering the internal microphone signal to generate a filtered signal indicative of at least some of the noise as captured by the external microphone, and generating a noise reduced signal indicative of the own voice content by subtracting the filtered signal from the external microphone signal.

EEE 2. The method of EEE 1, wherein the step of filtering the internal microphone signal to generate the filtered signal corresponds to application of a transfer function, InvP(z), to the internal microphone signal, so that said filtered signal is the signal, InvP(z)M, where M is the internal microphone signal, InvP(z) is the inverse of a transfer function, P(z), Se is ambient sound, which is noise originating from one or more sources external to the user of the headset, as sensed and captured by the external microphone, whereby said ambient sound, Se, is distinct from and does not include the own voice content, and P(z)Se is a signal at least substantially equal to the ambient sound, Se, as sensed and captured by the internal microphone, whereby the signal P(z)Se corresponds to the ambient sound, Se, after undergoing filtering by the transfer function P(z) during transit through the earpiece to the internal microphone.

EEE 3. The method of EEE 2, wherein step (b) includes a step of performing equalization on the noise reduced signal to reduce distortion of the own voice content indicated by the noise reduced signal, thereby generating an equalized noise reduced signal, wherein the step of performing equalization on the noise reduced signal corresponds to application of a transfer function, E(z), to the noise reduced signal, so that said equalized noise reduced signal is the signal, E(z)X, where X is the noise reduced signal, E(z) is at least substantially equal to $P(z)T^{-1}(z)$, $T^{-1}(z)$ is the inverse of a transfer function, T(z), and the transfer function, T(z), characterizes filtering of the own voice content due to transmission through a portion of the user's body to the internal microphone.

EEE 4. The method of EEE 3, wherein the transfer function, E(z), is a stable approximation to $P(z)T^{-1}(z)$.

EEE 5. The method of EEE 1, wherein step (b) includes a step of performing equalization on the noise reduced signal to reduce distortion of the own voice content indicated by the noise reduced signal, thereby generating an equalized noise reduced signal.

EEE 6. The method of EEE 3 or 5, wherein step (b) also includes a step of performing residual noise reduction on the equalized noise reduced signal.

EEE 7. The method of EEE 6, wherein the noise includes coherent noise and incoherent noise, subtraction of the filtered signal from the external microphone signal in step (b) removes most of the coherent noise from the external microphone signal, the noise reduced signal and the equalized noise reduced signal are indicative of at least some of the incoherent noise, and the residual noise reduction is performed so as to remove at least some of the incoherent noise from the equalized noise reduced signal.

EEE 8. The method of EEE 6 or 7, also including a step of:

performing own voice detection on at least one of the noise reduced signal, the equalized noise reduced signal, the external microphone signal, or the internal microphone signal to determine time segments of own voice activity, and wherein the step of performing residual noise reduction on the equalized noise reduced signal uses a noise estimate determined from at least one of the noise reduced signal, the equalized noise reduced signal, the external microphone signal, or the internal microphone signal at times between the time segments of own voice activity.

EEE 9. The method of EEE 8, wherein the step of performing own voice detection includes steps of:

comparing power of the noise reduced signal or the equalized noise reduced signal, and power of the external microphone signal, on a frame by frame basis;

identifying each frame, of the noise reduced signal or the equalized noise reduced signal, whose power is much smaller than the power of a corresponding frame of the external microphone signal as an own-voice absent frame corresponding to a time segment other than a time segment of own voice activity; and identifying each frame, of the noise reduced signal or the equalized noise reduced signal, whose power is not much smaller than the power of the corresponding frame of the external microphone signal as an own-voice frame corresponding to a time segment of own voice activity.

EEE 10. The method of EEE 8, wherein the step of performing own voice detection includes steps of:

comparing levels of frequency components of time segments of the internal microphone signal and levels of frequency components of corresponding time segments of the external microphone signal in a low frequency range;

determining that each time segment of the internal microphone signal and the external microphone signal in which the levels of the frequency components of the internal microphone signal are higher than the levels of the frequency components of the external microphone signal, in the low frequency range, is indicative of own voice activity; and determining that each time segment of the internal microphone signal and the external microphone signal in which the levels of the frequency components of the internal microphone signal are not higher than the levels of the frequency components of the external microphone signal, in the low frequency range, is not indicative of own voice activity.

EEE 11. The method of EEE 10, wherein the low frequency range is a range from a frequency at least substantially equal to 100 Hz to a frequency at least substantially equal to 500 Hz.

EEE 12. A headset, including:

at least one earpiece including an external microphone and an internal microphone configured to operate in the presence of sound including own voice content and noise, to generate an external microphone signal indicative of the sound as captured by the external microphone, and to generate an internal microphone signal indicative of the sound as captured by the internal microphone, where the own voice content is indicative of at least one vocal utterance of a user of the headset; and an audio processing system coupled to receive the external microphone signal and the internal microphone signal, and configured to perform noise reduction on the external microphone signal and the internal microphone signal to generate a noise reduced signal indicative of the own voice content, including by:

filtering the internal microphone signal to generate a filtered signal indicative of at least some of the noise as captured by the external microphone, and generating the noise reduced signal by subtracting the filtered signal from the external microphone signal.

EEE 13. The headset of EEE 12, wherein the audio processing system is configured to filter the internal microphone signal to generate the filtered signal in a manner corresponding to application of a transfer function, InvP(z), to said internal microphone signal, so that said filtered signal is the signal, InvP(z)M, where M is the internal microphone signal, InvP(z) is the inverse of a transfer function, P(z), Se is ambient sound, which is noise originating from one or more sources external to the user of the headset, as sensed and captured by the external microphone, whereby said ambient sound, Se, is distinct from and does not include the own voice content, and P(z)Se is a signal at least substantially equal to the ambient sound, Se, as sensed and captured by the internal microphone, whereby the signal P(z)Se corresponds to the ambient sound, Se, after undergoing filtering by the transfer function P(z) during transit through the earpiece to the internal microphone.

EEE 14. The headset of EEE 13, wherein the audio processing system includes an equalization subsystem coupled to receive the noise reduced signal and configured to perform equalization on said noise reduced signal to reduce distortion of the own voice content indicated by said noise reduced signal, thereby generating an equalized noise reduced signal, wherein the equalization on the noise reduced signal corresponds to application of a transfer function, E(z), to the noise reduced signal, so that said equalized noise reduced signal is the signal, E(z)X, where X is the noise reduced signal, E(z) is at least substantially equal to $P(z)T^{-1}(z)$, $T^{-1}(z)$ is the inverse of a transfer function, T(z), and the transfer function, T(z), characterizes filtering of the own voice content due to transmission through a portion of the user's body to the internal microphone.

EEE 15. The headset of EEE 14, wherein the transfer function, E(z), is a stable approximation to $P(z)T^{-1}(z)$.

EEE 16. The headset of EEE 12, wherein the audio processing system includes an equalization subsystem coupled to receive the noise reduced signal and configured to perform equalization on said noise reduced signal to reduce distortion of the own voice content indicated by said noise reduced signal, thereby generating an equalized noise reduced signal.

EEE 17. The headset of EEE 14 or 16, wherein the audio processing system also includes a noise reduction subsystem coupled and configured to perform residual noise reduction on the equalized noise reduced signal.

EEE 18. The headset of EEE 17, wherein the noise includes coherent noise and incoherent noise, the audio processing system is configured to subtract the filtered signal from the external microphone signal so as to remove most of the coherent noise from the external microphone signal, the noise reduced signal and the equalized noise reduced signal are indicative of at least some of the incoherent noise, and the noise reduction subsystem is configured to perform the residual noise reduction so as to remove at least some of the incoherent noise from the equalized noise reduced signal.

EEE 19. The headset of EEE 17 or 18, wherein the audio processing system also includes a voice detection subsystem coupled and configured to perform own voice detection on at least one of the noise reduced signal, the equalized noise reduced signal, the external microphone signal, or the internal microphone signal to determine time segments of own voice activity, and wherein the noise reduction subsystem is configured to perform the residual noise reduction on the equalized noise reduced signal using a noise estimate determined from at least one of the noise reduced signal, the equalized noise reduced signal, the external microphone signal, or the internal microphone signal at times between the time segments of own voice activity.

EEE 20. The headset of EEE 19, wherein the voice detection subsystem is configured to:

compare power of the noise reduced signal or the equalized noise reduced signal, and power of the external microphone signal, on a frame by frame basis;

identify each frame, of the noise reduced signal or the equalized noise reduced signal, whose power is much smaller than the power of a corresponding frame of the external microphone signal as an own-voice absent frame corresponding to a time segment other than a time segment of own voice activity; and identify each frame, of the noise reduced signal or the equalized noise reduced signal, whose power is not much smaller than the power of the corresponding frame of the external microphone signal as an own-voice frame corresponding to a time segment of own voice activity.

EEE 21. The headset of EEE 19, wherein the voice detection subsystem is configured to:

compare levels of frequency components of time segments of the internal microphone signal and levels of frequency components of corresponding time segments of the external microphone signal in a low frequency range;

determine that each time segment of the internal microphone signal and the external microphone signal in which the levels of the frequency components of the internal microphone signal are higher than the levels of the frequency components of the external microphone signal, in the low frequency range, is indicative of own voice activity; and determine that each time segment of the internal microphone signal and the external microphone signal in which the levels of the frequency components of the internal microphone signal are not higher than the levels of the frequency components of the external microphone signal, in the low frequency range, is not indicative of own voice activity.

EEE 22. The headset of EEE 21, wherein the low frequency range is a range from a frequency at least substantially equal to 100 Hz to a frequency at least substantially equal to 500 Hz.

EEE 23. An audio processing system for extracting own voice content captured by a microphone set of an earpiece of a headset, where the own voice content is indicative of at least one vocal utterance of a user of the headset and the microphone set includes an external microphone and an internal microphone, said audio processing system including:

at least one input coupled to receive an external microphone signal indicative of output of the external microphone and an internal microphone signal indicative of output of the internal microphone, where the external microphone signal and the internal microphone signal have been generated with the external microphone and the internal microphone in the presence of sound including noise and the own voice content, the external microphone signal is indicative of the sound as captured by the external microphone, and the internal microphone signal is indicative of the sound as captured by the internal microphone; and a noise cancellation subsystem coupled and configured to perform noise reduction on the external microphone signal and the internal microphone signal to generate a noise reduced signal indicative of the own voice content, including by:

filtering the internal microphone signal to generate a filtered signal indicative of at least some of the noise as captured by the external microphone, and generating the noise reduced signal by subtracting the filtered signal from the external microphone signal.

EEE 24. The system of EEE 23, wherein the noise cancellation subsystem is configured to filter the internal microphone signal to generate the filtered signal in a manner corresponding to application of a transfer function, InvP(z), to said internal microphone signal, so that said filtered signal is the signal, InvP(z)M, where M is the internal microphone signal, InvP(z) is the inverse of a transfer function, P(z), Se is ambient sound, which is noise originating from one or more sources external to the user of the headset, as sensed and captured by the external microphone, whereby said ambient sound, Se, is distinct from and does not include the own voice content, and P(z)Se is a signal at least substantially equal to the ambient sound, Se, as sensed and captured by the internal microphone, whereby the signal P(z)Se corresponds to the ambient sound, Se, after undergoing filtering by the transfer function P(z) during transit through the earpiece to the internal microphone.

EEE 25. The system of EEE 24, also including:

an equalization subsystem coupled to receive the noise reduced signal and configured to perform equalization on said noise reduced signal to reduce distortion of the own voice content indicated by said noise reduced signal, thereby generating an equalized noise reduced signal, wherein the equalization on the noise reduced signal corresponds to application of a transfer function, E(z), to the noise reduced signal, so that said equalized noise reduced signal is the signal, E(z)X, where X is the noise reduced signal, E(z) is at least substantially equal to $P(z)T^{-1}(z)$, $T^{-1}(z)$ is the inverse of a transfer function, T(z), and the transfer function, T(z), characterizes filtering of the own voice content due to transmission through a portion of the user's body to the internal microphone.

EEE 26. The system of EEE 25, wherein the transfer function, E(z), is a stable approximation to $P(z)T^{-1}(z)$.

EEE 27. The system of EEE 23, also including:

an equalization subsystem coupled to receive the noise reduced signal and configured to perform equalization on said noise reduced signal to reduce distortion of the own voice content indicated by said noise reduced signal, thereby generating an equalized noise reduced signal.

EEE 28. The system of EEE 25 or 27, also including:

a noise reduction subsystem coupled and configured to perform residual noise reduction on the equalized noise reduced signal.

EEE 29. The system of EEE 28, wherein the noise includes coherent noise and incoherent noise, the noise cancellation subsystem is configured to subtract the filtered signal from the external microphone signal so as to remove most of the coherent noise from the external microphone signal, the noise reduced signal and the equalized noise reduced signal are indicative of at least some of the incoherent noise, and the noise reduction subsystem is configured to perform the residual noise reduction so as to remove at least some of the incoherent noise from the equalized noise reduced signal.

EEE 30. The system of EEE 28 or 29, also including:

a voice detection subsystem coupled and configured to perform own voice detection on at least one of the noise reduced signal, the equalized noise reduced signal, the external microphone signal, or the internal microphone signal to determine time segments of own voice activity, and wherein the noise reduction subsystem is configured to perform the residual noise reduction on the equalized noise reduced signal using a noise estimate determined from at least one of the noise reduced signal, the equalized noise reduced signal, the external microphone signal, or the internal microphone signal at times between the time segments of own voice activity.

EEE 31. The system of EEE 30, wherein the voice detection subsystem is configured to:

compare power of the noise reduced signal or the equalized noise reduced signal, and power of the external microphone signal, on a frame by frame basis;

identify each frame, of the noise reduced signal or the equalized noise reduced signal, whose power is much smaller than the power of a corresponding frame of the external microphone signal as an own-voice absent frame corresponding to a time segment other than a time segment of own voice activity; and identify each frame, of the noise reduced signal or the equalized noise reduced signal, whose power is not much smaller than the power of the corresponding frame of the external microphone signal as an own-voice frame corresponding to a time segment of own voice activity.

EEE 32. The system of EEE 30, wherein the voice detection subsystem is configured to:

compare levels of frequency components of time segments of the internal microphone signal and levels of frequency components of corresponding time segments of the external microphone signal in a low frequency range;

determine that each time segment of the internal microphone signal and the external microphone signal in which the levels of the frequency components of the internal microphone signal are higher than the levels of the frequency components of the external microphone signal, in the low frequency range, is indicative of own voice activity; and determine that each time segment of the internal microphone signal and the external microphone signal in which the levels of the frequency components of the internal microphone signal are not higher than the levels of the frequency components of the external microphone signal, in the low frequency range, is not indicative of own voice activity.

EEE 33. The system of EEE 32, wherein the low frequency range is a range from a frequency at least substantially equal to 100 Hz to a frequency at least substantially equal to 500 Hz.

EEE 34. A tangible, computer readable medium which stores, in a non-transitory manner, code for programming an audio processing system to perform processing on an external microphone signal indicative of output of an external microphone of an earpiece of a headset and an internal microphone signal indicative of output of an internal microphone of the earpiece, where the external microphone signal and the internal microphone signal have been generated with the external microphone and the internal microphone in the presence of sound including noise and own voice content, the external microphone signal is indicative of the sound as captured by the external microphone, the internal microphone signal is indicative of the sound as captured by the internal microphone, and the own voice content is indicative of at least one vocal utterance of a user of the headset, said processing including a step of:

performing noise reduction on the external microphone signal, including by filtering the internal microphone signal to generate a filtered signal indicative of at least some of the noise as captured by the external microphone, and generating a noise reduced signal indicative of the own voice content by subtracting the filtered signal from the external microphone signal.

EEE 35. The medium of EEE 34, wherein the step of filtering the internal microphone signal to generate the filtered signal corresponds to application of a transfer function, InvP(z), to the internal microphone signal, so that said filtered signal is the signal, InvP(z)M, where M is the internal microphone signal, InvP(z) is the inverse of a transfer function, P(z), Se is ambient sound, which is noise originating from one or more sources external to the user of the headset, as sensed and captured by the external microphone, whereby said ambient sound, Se, is distinct from and does not include the own voice content, and P(z)Se is a signal at least substantially equal to the ambient sound, Se, as sensed and captured by the internal microphone, whereby the signal P(z)Se corresponds to the ambient sound, Se, after undergoing filtering by the transfer function P(z) during transit through the earpiece to the internal microphone.

EEE 36. The medium of EEE 35, wherein the processing also includes a step of performing equalization on the noise reduced signal to reduce distortion of the own voice content indicated by the noise reduced signal, thereby generating an equalized noise reduced signal, wherein the step of performing equalization on the noise reduced signal corresponds to application of a transfer function, E(z), to the noise reduced signal, so that said equalized noise reduced signal is the signal, E(z)X, where X is the noise reduced signal, E(z) is at least substantially equal to $P(z)T^{-1}(z)$, $T^{-1}(z)$ is the inverse of a transfer function, T(z), and the transfer function, T(z), characterizes filtering of the own voice content due to transmission through a portion of the user's body to the internal microphone.

EEE 37. The medium of EEE 36, wherein the transfer function, E(z), is a stable approximation to $P(z)T^{-1}(z)$.

EEE 38. The medium of EEE 34, wherein the processing also includes a step of performing equalization on the noise reduced signal to reduce distortion of the own voice content indicated by the noise reduced signal, thereby generating an equalized noise reduced signal.

EEE 39. The medium of EEE 36 or 38, wherein the processing also includes a step of performing residual noise reduction on the equalized noise reduced signal.

EEE 40. The medium of EEE 39, wherein the processing also includes a step of:

performing own voice detection on at least one of the noise reduced signal, the equalized noise reduced signal, the external microphone signal, or the internal microphone signal to determine time segments of own voice activity, and wherein the step of performing residual noise reduction on the equalized noise reduced signal uses a noise estimate determined from at least one of the noise reduced signal, the equalized noise reduced signal, the external microphone signal, or the internal microphone signal at times between the time segments of own voice activity.

EEE 41. The medium of EEE 40, wherein the step of performing own voice detection includes steps of:

comparing power of the noise reduced signal or the equalized noise reduced signal, and power of the external microphone signal, on a frame by frame basis;

identifying each frame, of the noise reduced signal or the equalized noise reduced signal, whose power is much smaller than the power of a corresponding frame of the external microphone signal as an own-voice absent frame corresponding to a time segment other than a time segment of own voice activity; and identifying each frame, of the noise reduced signal or the equalized noise reduced signal, whose power is not much smaller than the power of the corresponding frame of the external microphone signal as an own-voice frame corresponding to a time segment of own voice activity.

EEE 42. The medium of EEE 40, wherein the step of performing own voice detection includes steps of:

comparing levels of frequency components of time segments of the internal microphone signal and levels of frequency components of corresponding time segments of the external microphone signal in a low frequency range;

determining that each time segment of the internal microphone signal and the external microphone signal in which the levels of the frequency components of the internal microphone signal are higher than the levels of the frequency components of the external microphone signal, in the low frequency range, is indicative of own voice activity; and determining that each time segment of the internal microphone signal and the external microphone signal in which the levels of the frequency components of the internal microphone signal are not higher than the levels of the frequency components of the external microphone signal, in the low frequency range, is not indicative of own voice activity.

A number of embodiments of the invention have been described. It should be understood that various modifications may be made without departing from the spirit and scope of the invention. Numerous modifications and variations of embodiments of the present invention are possible in light of the above teachings. It is to be understood that within the scope of the appended EEEs, embodiments of the invention may be practiced otherwise than as specifically described herein.

The invention claimed is:

1. A method for capturing sound using a headset having at least one earpiece, wherein a user's ear canal is closed by the earpiece, the earpiece including an external microphone and an internal microphone, wherein the internal microphone is positioned in or on an inside portion of the earpiece and the external microphone is positioned in or on an outside portion of the earpiece, and wherein the internal microphone is located in a chamber formed by the earpiece and an ear of the user, said method including steps of:

(a) in the presence of sound including own voice content and noise, generating an external microphone signal indicative of the sound as captured by the external microphone, and generating an internal microphone signal indicative of the sound as captured by the internal microphone, where the own voice content is indicative of at least one vocal utterance of the user of the headset; and (b) performing noise reduction on the external microphone signal, including by filtering the internal microphone signal to generate a filtered signal indicative of at least some of the noise as captured by the external microphone, and generating a noise reduced signal indicative of the own voice content by subtracting the filtered signal from the external microphone signal, wherein the step of filtering the internal microphone signal to generate the filtered signal corresponds to application of a transfer function, InvP(z), to the internal microphone signal, wherein the transfer function, InvP(z), is equal to or at least substantially equal to an inverse of a transfer function, P(z), that represents filtering during transit through the earpiece to the internal microphone.

2. The method of claim 1, wherein the step of filtering the internal microphone signal to generate the filtered signal corresponds to application of the transfer function, InvP(z), to the internal microphone signal, so that said filtered signal is the signal, InvP(z)M, where M is the internal microphone signal, InvP(z) is the inverse of the transfer function, P(z), Se is ambient sound, which is noise originating from one or more sources external to the user of the headset, as sensed and captured by the external microphone, whereby said ambient sound, Se, is distinct from and does not include the own voice content, and P(z)Se is a signal at least substantially equal to the ambient sound, Se, as sensed and captured by the internal microphone, whereby the signal P(z)Se corresponds to the ambient sound, Se, after undergoing filtering by the transfer function P(z) during transit through the earpiece to the internal microphone.

3. The method of claim 2, wherein step (b) includes a step of performing equalization on the noise reduced signal to reduce distortion of the own voice content indicated by the noise reduced signal, thereby generating an equalized noise reduced signal, wherein the step of performing equalization on the noise reduced signal corresponds to application of a transfer function, E(z), to the noise reduced signal, so that said equalized noise reduced signal is the signal, E(z)X, where X is the noise reduced signal, E(z) is at least substantially equal to P(z)InvT(z), InvT(z) is the inverse of a transfer function, T(z), and the transfer function, T(z), characterizes filtering of the own voice content due to transmission through a portion of the user's body to the internal microphone.

4. The method of claim 3, wherein the transfer function, E(z), is a stable approximation to P(z)InvT(z).

5. The method of claim 1, wherein step (b) includes a step of performing equalization on the noise reduced signal to reduce distortion of the own voice content indicated by the noise reduced signal, thereby generating an equalized noise reduced signal.

6. The method of claim 1, wherein step (b) includes performing residual noise reduction on the equalized noise reduced signal.

7. The method of claim 6, wherein the noise includes coherent noise and incoherent noise, subtraction of the filtered signal from the external microphone signal in step (b) removes most of the coherent noise from the external microphone signal, the noise reduced signal and the equalized noise reduced signal are indicative of at least some of the incoherent noise, and the residual noise reduction is performed so as to remove at least some of the incoherent noise from the equalized noise reduced signal.

8. The method of claim 6, also including a step of:

performing own voice detection on at least one of the noise reduced signal, the equalized noise reduced signal, the external microphone signal, or the internal microphone signal to determine time segments of own voice activity, and wherein the step of performing residual noise reduction on the equalized noise reduced signal uses a noise estimate determined from at least one of the noise reduced signal, the equalized noise reduced signal, the external microphone signal, or the internal microphone signal at times between the time segments of own voice activity.

9. The method of claim 8, wherein the step of performing own voice detection includes steps of:

comparing power of the noise reduced signal or the equalized noise reduced signal, and power of the external microphone signal, on a frame by frame basis;

identifying each frame, of the noise reduced signal or the equalized noise reduced signal, whose power is much smaller than the power of a corresponding frame of the external microphone signal as an own-voice absent frame corresponding to a time segment other than a time segment of own voice activity; and identifying each frame, of the noise reduced signal or the equalized noise reduced signal, whose power is not much smaller than the power of the corresponding frame of the external microphone signal as an own-voice frame corresponding to a time segment of own voice activity.

10. The method of claim 8, wherein the step of performing own voice detection includes steps of:

comparing levels of frequency components of time segments of the internal microphone signal and levels of frequency components of corresponding time segments of the external microphone signal in a low frequency range;

determining that each time segment of the internal microphone signal and the external microphone signal in which the levels of the frequency components of the internal microphone signal are higher than the levels of the frequency components of the external microphone signal, in the low frequency range, is indicative of own voice activity; and determining that each time segment of the internal microphone signal and the external microphone signal in which the levels of the frequency components of the internal microphone signal are not higher than the levels of the frequency components of the external microphone signal, in the low frequency range, is not indicative of own voice activity.

11. The method of claim 10, wherein the low frequency range is a range from a frequency at least substantially equal to 100 Hz to a frequency at least substantially equal to 500 Hz.

12. A headset, including:

at least one earpiece including an external microphone positioned in or on an outside portion of the earpiece and an internal microphone positioned in or on an inside portion of the earpiece, wherein a user's ear canal is closed by the earpiece and the internal microphone is located in a chamber formed by the earpiece and an ear of the user, configured to operate in the presence of sound including own voice content and noise, to generate an external microphone signal indicative of the sound as captured by the external microphone, and to generate an internal microphone signal indicative of the sound as captured by the internal microphone, where the own voice content is indicative of at least one vocal utterance of the user of the headset; and an audio processing system coupled to receive the external microphone signal and the internal microphone signal, and configured to perform noise reduction on the external microphone signal and the internal microphone signal to generate a noise reduced signal indicative of the own voice content, including by:

filtering the internal microphone signal to generate a filtered signal indicative of at least some of the noise as captured by the external microphone, and generating the noise reduced signal by subtracting the filtered signal from the external microphone signal, wherein the audio processing system is configured to filter the internal microphone signal to generate the filtered signal in a manner corresponding to application of a transfer function, InvP(z), to the internal microphone signal, wherein the transfer function, InvP(z), is equal to or at least substantially equal to an inverse of a transfer function, P(z), that represents filtering during transit through the earpiece to the internal microphone.

13. The headset of claim 12, wherein the audio processing system is configured to filter the internal microphone signal to generate the filtered signal in a manner corresponding to application of the transfer function, InvP(z), to said internal microphone signal, so that said filtered signal is the signal, InvP(z)M, where M is the internal microphone signal, InvP(z) is the inverse of the transfer function, P(z), Se is ambient sound, which is noise originating from one or more sources external to the user of the headset, as sensed and captured by the external microphone, whereby said ambient sound, Se, is distinct from and does not include the own voice content, and P(z)Se is a signal at least substantially equal to the ambient sound, Se, as sensed and captured by the internal microphone, whereby the signal P(z)Se corresponds to the ambient sound, Se, after undergoing filtering by the transfer function P(z) during transit through the earpiece to the internal microphone.

14. The headset of claim 12, wherein the audio processing system includes an equalization subsystem coupled to receive the noise reduced signal and configured to perform equalization on said noise reduced signal to reduce distortion of the own voice content indicated by said noise reduced signal, thereby generating an equalized noise reduced signal.

15. The headset of claim 14, wherein the audio processing system also includes a noise reduction subsystem coupled and configured to perform residual noise reduction on the equalized noise reduced signal.

16. An audio processing system for extracting own voice content captured by a microphone set of an earpiece of a headset, where the own voice content is indicative of at least one vocal utterance of a user of the headset and the microphone set includes an external microphone positioned in or on an outside portion of the earpiece and an internal microphone positioned in or on an inside portion of the earpiece, wherein the user's ear canal is closed by the earpiece and the internal microphone is located in a chamber formed by the earpiece and an ear of the user, said audio processing system including:

at least one input coupled to receive an external microphone signal indicative of output of the external microphone and an internal microphone signal indicative of output of the internal microphone, where the external microphone signal and the internal microphone signal have been generated with the external microphone and the internal microphone in the presence of sound including noise and the own voice content, the external microphone signal is indicative of the sound as captured by the external microphone, and the internal microphone signal is indicative of the sound as captured by the internal microphone; and a noise cancellation subsystem coupled and configured to perform noise reduction on the external microphone signal and the internal microphone signal to generate a noise reduced signal indicative of the own voice content, including by:

filtering the internal microphone signal to generate a filtered signal indicative of at least some of the noise as captured by the external microphone, and generating the noise reduced signal by subtracting the filtered signal from the external microphone signal, wherein the noise cancellation subsystem is configured to filter the internal microphone signal to generate the filtered signal in a manner corresponding to application of a transfer function, InvP(z), to the internal microphone signal, wherein the transfer function, InvP(z), is equal to or at least substantially equal to an inverse of a transfer function, P(z), that represents filtering during transit through the earpiece to the internal microphone.

17. The system of claim 16, wherein the noise cancellation subsystem is configured to filter the internal microphone signal to generate the filtered signal in a manner corresponding to application of the transfer function, InvP(z), to said internal microphone signal, so that said filtered signal is the signal, InvP(z)M, where M is the internal microphone signal, InvP(z) is the inverse of the transfer function, P(z), Se is ambient sound, which is noise originating from one or more sources external to the user of the headset, as sensed and captured by the external microphone, whereby said ambient sound, Se, is distinct from and does not include the own voice content, and P(z)Se is a signal at least substantially equal to the ambient sound, Se, as sensed and captured by the internal microphone, whereby the signal P(z)Se corresponds to the ambient sound, Se, after undergoing filtering by the transfer function P(z) during transit through the earpiece to the internal microphone.

18. The system of claim 16, also including:

an equalization subsystem coupled to receive the noise reduced signal and configured to perform equalization on said noise reduced signal to reduce distortion of the own voice content indicated by said noise reduced signal, thereby generating an equalized noise reduced signal.

19. The system of claim 18, also including:

a noise reduction subsystem coupled and configured to perform residual noise reduction on the equalized noise reduced signal.

20. A tangible, computer readable medium which stores, in a non-transitory manner, code for programming an audio processing system to perform processing on an external microphone signal indicative of output of an external microphone of an earpiece of a headset and an internal microphone signal indicative of output of an internal microphone of the earpiece, wherein the internal microphone is positioned in or on an inside portion of the earpiece and the external microphone is positioned in or on an outside portion of the earpiece, wherein a user's ear canal is closed by the earpiece and the internal microphone is located in a chamber formed by the earpiece and an ear of the user, and where the external microphone signal and the internal microphone signal have been generated with the external microphone and the internal microphone in the presence of sound including noise and own voice content, the external microphone signal is indicative of the sound as captured by the external microphone, the internal microphone signal is indicative of the sound as captured by the internal microphone, and the own voice content is indicative of at least one vocal utterance of the user of the headset, said processing including a step of:

performing noise reduction on the external microphone signal, including by filtering the internal microphone signal to generate a filtered signal indicative of at least some of the noise as captured by the external microphone, and generating a noise reduced signal indicative of the own voice content by subtracting the filtered signal from the external microphone signal, wherein the step of filtering the internal microphone signal to generate the filtered signal corresponds to application of a transfer function, InvP(z), to the internal microphone signal, wherein the transfer function, InvP(z), is equal to or at least substantially equal to an inverse of a transfer function, P(z), that represents filtering during transit through the earpiece to the internal microphone.

* * * * *